US006603398B2

(12) United States Patent
Tinone et al.

(10) Patent No.: US 6,603,398 B2
(45) Date of Patent: Aug. 5, 2003

(54) HOISTWAY ACCESS DETECTION SYSTEM

(75) Inventors: Helio Tinone, Simsbury, CT (US); Frank W. Adams, Avon, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/991,444

(22) Filed: Nov. 16, 2001

(65) Prior Publication Data

US 2003/0094332 A1 May 22, 2003

(51) Int. Cl.[7] ..... G08B 13/00

(52) U.S. Cl. ..... 340/541; 340/545.1; 340/545.3; 340/545.9; 187/316; 187/390; 187/391; 187/393; 187/400

(58) Field of Search ..... 340/541, 545.1, 340/545.3, 545.6, 545.9, 565; 187/391, 209, 276, 280, 287, 288, 307, 316, 390, 393, 400, 248, 247

(56) References Cited

U.S. PATENT DOCUMENTS 4,592,270 A * 6/1986 Vener ..... 98/39.1
5,025,895 A * 6/1991 Leone et al. ..... 187/105
5,283,400 A * 2/1994 Leone et al. ..... 187/140
5,347,094 A * 9/1994 Leone et al. ..... 187/140
5,443,142 A * 8/1995 Glaser ..... 187/316
5,476,157 A * 12/1995 Todaro ..... 187/280
5,644,111 A * 7/1997 Cerny et al. ..... 187/393
6,050,369 A * 4/2000 Leone et al. ..... 187/392
6,173,814 B1 * 1/2001 Herkel et al. ..... 187/288

FOREIGN PATENT DOCUMENTS

EP 0 455 919 A2 11/1991
EP 1 110 900 A1 6/2001

* cited by examiner

*Primary Examiner*—Toan Pham

(57) ABSTRACT

An improved hoistway access detection system including three safety chains, one for monitoring door position on the even numbered floors, one for monitoring door position on the odd numbered floors, and one for monitoring the position of the pit door, wherein an elevator car is slowly moved to the alternate floor upon detection and subsequent closure of an open pit door and any landing door.

11 Claims, 2 Drawing Sheets

HOISTWAY ACCESS DETECTION SYSTEM

TECHNICAL FIELD

This invention relates to a method and apparatus for improving elevator safety and more particularly for detecting intrusion into an elevator hoistway.

BACKGROUND ART

Persons that enter a hoistway, such as mechanics, maintenance personnel, and unauthorized persons may be injured by sudden unexpected movement of the elevator car. The condition of hoistway doors and elevator doors are constantly monitored to ensure that authorized personnel follow safety procedures when entering the hoistway and that no car movement is allowed upon entry of unauthorized personnel.

It is known in the prior art to monitor the switches on each landing door and the car door to determine if the doors are closed. The door switches from each door are normally wired in series to form a safety chain. High speed movement of the car is prevented whenever one of the doors is open. The car is allowed to resume normal operation when the doors are closed and the safety chain is made.

However, there exists a problem in the prior art in that if the elevator door and the corresponding landing door are open to allow passengers to enter or exit the car the safety chain is broken. A second open landing door cannot be detected. Therefore someone could enter the pit area at the bottom of the hoistway or step onto the top of the car from a landing above while the car is stopped for normal operation. Once all the doors are closed the elevator will resume normal operation which could result in injury to person above the car or in the pit.

Therefore there exists a need for an improved method and apparatus for detecting the presence of an unauthorized person entering the hoistway.

DISCLOSURE OF INVENTION

Objects of the invention include an improved method and apparatus for detecting the presence of an unauthorized person in the hoistway.

According to the present invention, a first safety chain is formed from the door sensors from the landings of the even numbered floors. A second safety chain is formed from the door sensors from the odd numbered floors and a third safety chain is formed from the door sensor from the pit door, which provides access to the pit at the bottom of the hoistway. In some elevator installations the bottom landing door also provides access to the pit.

The first, second, and third safety chains are monitored by software or logic located in the elevator controller. Depending on the status of the elevator car and safety chains the controller will allow the car to operate normally or stop the car and direct it to a nearest floor. The car will remain there until the controller receives a reset signal.

If no landing doors are open then there can be no entry to the hoistway. Therefore the controller will continue to monitor the status of three safety chains and allow normal operation.

In a first scenario, the controller will determine if the car is moving in normal operation and a landing door is open. If both conditions are satisfied, the controller will stop the car. The logic will then proceed to determine if either the pit door or another landing door above the car top is open. If either condition is satisfied the car will stop and after the door is closed, proceed to a landing, at low speed, and stop to allow passengers to exit. The car will remain there until a reset signal is received and the open pit and/or landing doors are closed. The car will then resume normal operation.

In a second scenario with the car stopped at a landing and the corresponding landing door open, the car will remain stopped upon detection of either an open pit door or an open door above the car. The elevator will be allowed to return to normal operation upon detection of a reset signal.

BEST MODE FOR CARRYING OUT THE INVENTION

Figure 1:
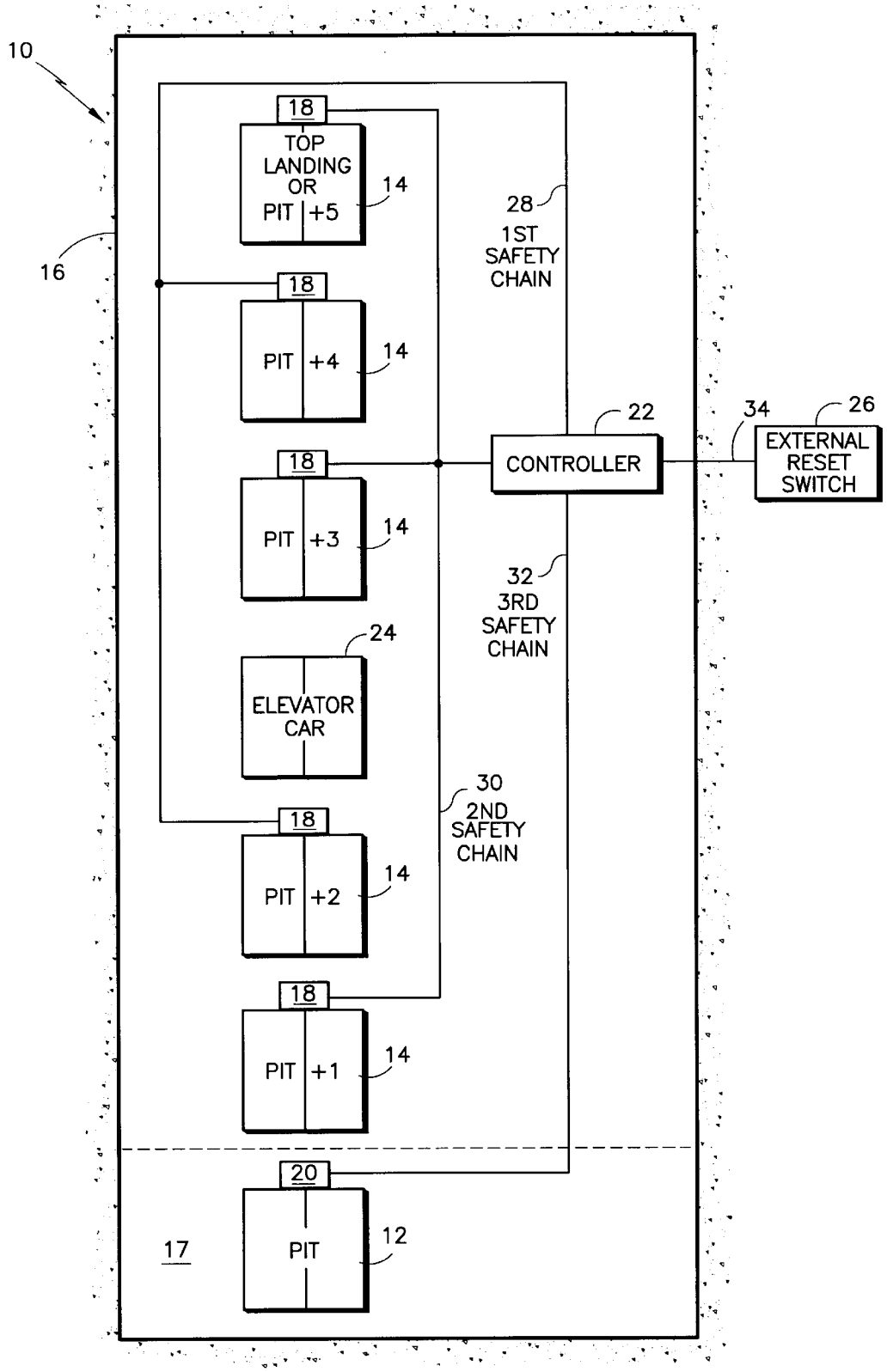
FIG. 1 is a schematic of the subject invention according to a preferred embodiment.

According to the present invention, a hoistway detection system 10 includes a pit landing door 12 and a series of landing doors 14 associated with each landing of the hoistway 16. Associated with the pit door 12 is door sensor 20, to determine whether the door is open of closed. Door sensors 18 monitor whether each associated landing door 14 is open or closed. Each sensor 18 and 20 is wired in series in one of three safety chains 28, 30, and 32. The first safety chain 28 includes the sensors 18 for the even numbered floors i.e. Pit+2 and Pit+4. The second safety chain 30 includes the sensors 18 for the odd numbered floors i.e. Pit+1–Pit+5 and the third safety chain 32 includes the pit door sensor 20.

The most likely reason for two landing doors 14 to be open is to gain access to the top of the car 24, or pit 17 located at the bottom of the hoistway 16. The pit 17 is illustrated as having its own door 12 for access. However the pit area simply refers to the bottom of the hoistway and may be accessible by ladder from the lowest landing, or simply through the lowest landing. Therefore if the elevator 24 is stopped at an even number floor a person trying to gain access to the top of the car 24 would open the door one floor above, which is an odd numbered floor. By wiring the even and odd numbered floors in two separate chains the logic 100 can detect someone trying to gain unauthorized access to the top of the car 24. Unauthorized access to the pit 17 can be detected in much the same manner. By having a separate safety chain 32 for the pit unauthorized entry can be determined by detecting an open landing door 14 and the pit door 12 being open at the same time.

Figure 2:
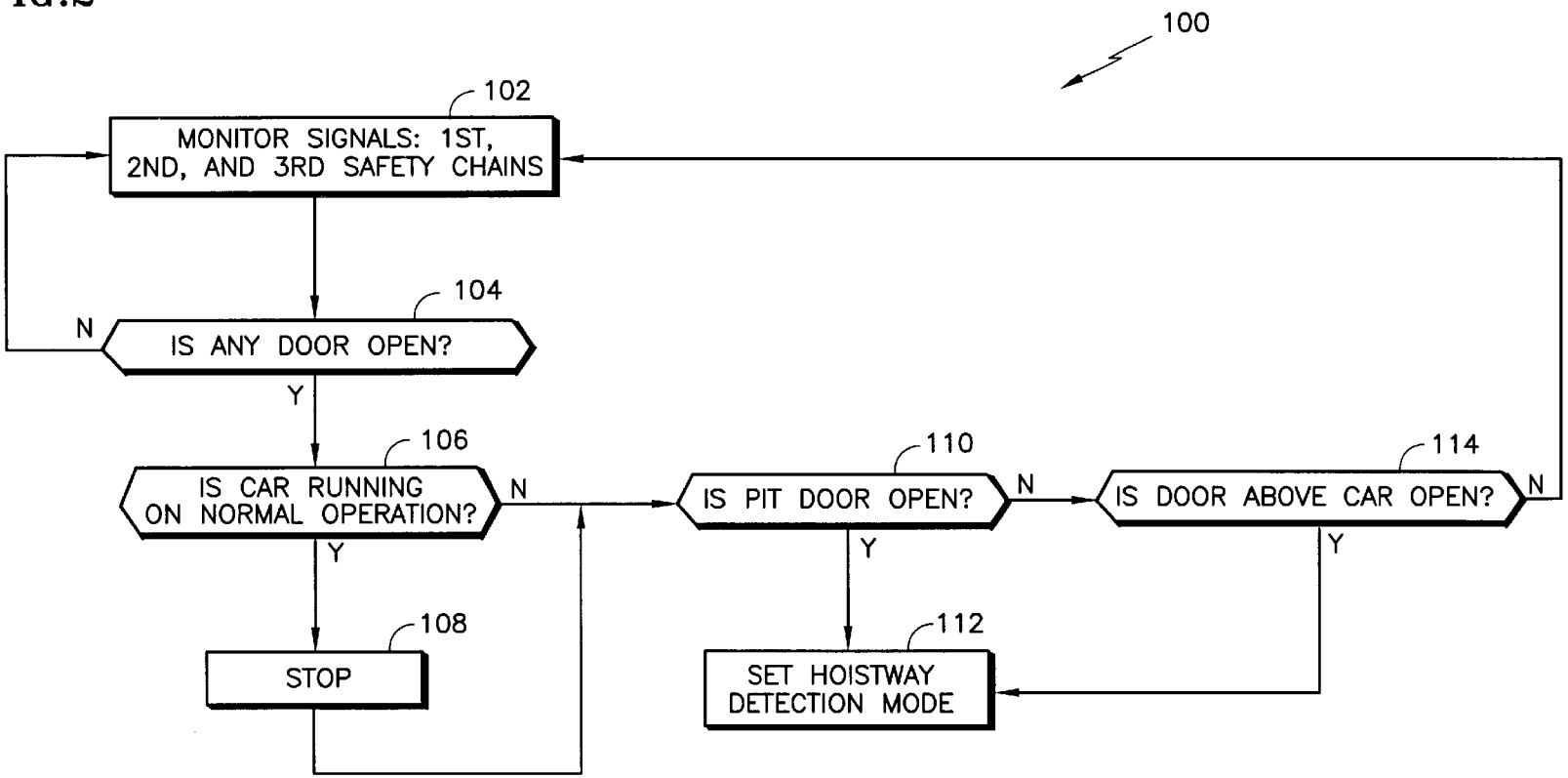
FIG. 2 is high level flow diagram of the monitoring logic for the subject invention.

The controller 22 monitors each safety chain 28, 30, and 32 performing the logic functions as shown in FIG. 2. The monitoring subroutine 100 begins at step 102 with the controller monitoring the signals from the landing 18 and pit sensors 20 via the first 28, second 30, and third 32 safety chains and movement of the elevator car 24 within the hoistway 16.

At step 104 the logic determines whether any of the landing doors 14 or pit door 12 are open. If any door 14 or 12 is open either the first 28, second 30 or third 32 safety chain will be broken. If no door is open then no one can enter the hoistway and the logic returns to step 102. If either the first 28, second 30 or third 32 safety chain is broken, indicating a landing door 14 or pit door 12 is open, the logic proceeds to step 106. For this example it is assumed that the door Pit+2 is open which results in a break in the first safety chain 28. At step 106 the logic determines whether the elevator 24 is moving. If the car 24 is moving then someone may gain unauthorized access to the hoistway 16. Therefore the logic moves to step 108 where the elevator car 24 is stopped from further movement.

The logic then proceeds to step 110 to determine if the pit door 12 is open, which would result in a break in the third safety chain 32. If the pit door 12 is open then the logic proceeds to step 112 and the controller 22 directs car 24 to an alternate landing, at low speed, to allow passengers exit the elevator 24. The car 24 remains at this landing until a reset signal 34 is received by the controller 22 from an external switch 26.

If the pit door 12 is not open then the logic proceeds to step 114 to determine if the other safety chain (in this example the second safety chain 30) is open. If the second safety chain 30 is broken then the logic proceeds to step 112 and the elevator car 24 is directed to an alternate landing, at low speed, to allow passengers to exit the elevator car 24. If neither the second 30 nor third 32 safety chains are broken the car 24 remains stopped and the logic returns to step 102 to repeat the process. Once the door is closed the elevator returns to normal operation.

In a second scenario where someone may be trying to gain unauthorized access to the top of the elevator car 24 or to the pit 17. The logic first determines, at step 104, whether a landing door 14 is open and then proceeds to step 106 to determine if the elevator car 24 is stopped at a landing 14. If these two conditions are satisfied the logic proceeds to step 110 to determine if the third safety chain 32 is open. If the third safety chain 32 is open, indicating the pit door 12 is open, then the logic proceeds to step 112. The elevator will remain in this stopped position until the controller 22 receives a reset signal 34 by way of an external switch 26. The reset signal 34 could originate from a switch on the controller, a pit switch or other appropriate signal.

If the third safety chain 32 is not broken then the logic proceeds to step 114 to detect whether a door above the car is open. Assuming the car is stopped at an odd numbered floor the logic would determine if the first safety chain 28 is broken. This would indicate, for the present example, that one of the even numbered floors is open. If a door 14 of an even numbered floor is open, the logic would then proceed to step 112. The car 24 would remain at this landing until an external reset signal 34 is received. If neither the pit door 12, associated with the third safety chain 32, or a landing door 14 associated with the first safety chain 28, is open then the logic returns to step 102 and the process is repeated.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

I claim:

1. A method for detecting intrusion into a hoistway of elevator, the hoistway including multiple landing doors, door sensors at each landing for monitoring the position of the landing doors, the hoistway being adapted for movement of an elevator car therein, the hoistway further including a first safety chain comprising outputs from the door sensors from the even numbered landings electrically connected in series, and a second safety chain comprising outputs from the door sensors from the odd numbered landings electrically connected in series, the method for detecting comprising:

determining whether said first safety chain is open;

determining whether said second safety chain is open; and executing a hoistway detection mode wherein said elevator car is prevented from moving upon the determination that said first safety chain, and said second safety chain are open.

2. The method of claim 1 further comprising:

detecting whether the elevator car is moving; and executing the hoistway detection mode upon the determination that said first or second safety chain is open and said car is moving.

3. The method of claim 2, said hoistway detection method further comprising:

moving said car tca landing to release any passengers in the car prior to ceasing movement.

4. The method of claim 1 wherein the hoistway further includes a third safety chain comprising the output from a pit door sensor, the method comprising;

determining whether the third safety chain is open; and executing the hoistway detection mode upon a determination that the third safety chain is open and either the first or second safety chain is open.

5. A detection system for a hoistway, the hoistway including multiple landing doors, door sensors at each landing for monitoring the position of the landing doors, the hoistway being adapted for movement of an elevator car therein, the detection system comprising:

a first safety chain comprising outputs from the door sensors from the even numbered landings electrically connected in series;

a second safety chain comprising outputs from the door sensors from the odd numbered landings electrically connected in series; and a controller for monitoring the first and second safety chains and for controlling movement of the elevator car within the hoistway, said controller executing a hoistway detection mode wherein said elevator car is prevented from moving upon a determination that the first and second safety chains are open.

6. The hoistway detection system of claim 5 wherein said controller causes said elevator car to move at slow speed to a landing upon a determination that the car is moving.

7. The hoistway detection system of claim 5 wherein the hoistway further includes, a pit located at the bottom of the hoistway having a pit door providing access thereto, the pit door position being monitored by a pit door sensor, the system further comprising a third safety chain comprising the output from the pit door sensor wherein the controller executes the hoistway detection mode upon a determination that the first or second safety chain is open and the third safety chain is open.

8. A method for detecting intrusion into a hoistway of elevator, the hoistway including multiple landing doors, door sensors at each landing for monitoring the position of the landing doors, a pit located at the bottom of the hoistway having a pit door providing access thereto, the pit door position being monitored by a pit door sensor, the hoistway being adapted for movement of an elevator car therein, the hoistway further including a first safety chain comprising outputs from the door sensors from the even numbered landings electrically connected in series, a second safety chain comprising outputs from the door sensors from the odd numbered landings electrically connected in series, and a third safety chain comprising the output from the pit door sensor, the method for detecting comprising:

determining whether said first or second safety chain is open;

determining whether said third safety chain is open; and executing a hoistway detection mode wherein said elevator car is prevented from moving upon a determination that said first safety chain or second safety chain and said third safety chain is open.

9. The method of claim 1 or 8 further comprising:

resuming normal operation upon receipt of a reset command.

10. The method of claim 8 further comprising:

preventing movement of said car upon a determination that said first, second, or third safety chain is open and said car is moving.

11. The method of claim 10, said hoistway detection method further comprising:

moving said car to a landing to release any passengers in the car prior to ceasing movement.

* * * * *